US009796936B2

(12) United States Patent
Lei et al.

(10) Patent No.: US 9,796,936 B2
(45) Date of Patent: Oct. 24, 2017

(54) PRODUCTION OF HEAVY API GROUP II BASE OIL

(71) Applicant: Chevron U.S.A. Inc., San Ramon, CA (US)

(72) Inventors: Guan-Dao Lei, Walnut Creek, CA (US); Subhasis Bhattacharya, Walnut Creek, CA (US); Axel Brait, San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 14/848,917

(22) Filed: Sep. 9, 2015

(65) Prior Publication Data

US 2017/0066979 A1 Mar. 9, 2017

(51) Int. Cl.
*C10G 67/16* (2006.01)
*C10G 67/00* (2006.01)
(Continued)

(52) U.S. Cl.
CPC ..... *C10G 67/16* (2013.01); *C10G 53/06* (2013.01); *C10G 67/00* (2013.01); *C10G 67/0409* (2013.01); *C10G 67/0418* (2013.01); *C10G 67/0445* (2013.01); *C10G 73/06* (2013.01); *C10M 101/00* (2013.01); *C10M 177/00* (2013.01); *C10G 2300/1096* (2013.01); *C10G 2400/08* (2013.01)

(58) Field of Classification Search
CPC ..... C10G 67/00; C10G 67/02; C10G 67/04; C10G 67/16; C10M 101/00; C10M 101/02; C10M 101/025
See application file for complete search history.

(56) References Cited

U.S. PATENT DOCUMENTS 3,763,033 A * 10/1973 Stauffer ..... C10G 45/00 208/18
4,622,130 A 11/1986 Stem
(Continued)

FOREIGN PATENT DOCUMENTS

EP 237655 A1 6/1992

OTHER PUBLICATIONS

J. Speight: Synthetic Fuels Handbook, ISBN 007149023, 2008, p. 64.

*Primary Examiner* — Brian McCaig
(74) *Attorney, Agent, or Firm* — Mark L. Warzel

(57) ABSTRACT

A process for heavy base oil production, comprising: a. performing an aromatic extraction of a first hydrocarbon feed to produce an aromatic extract, and a waxy raffinate; b. mixing the aromatic extract with a second hydrocarbon feed to make a mixed feed having greater than 2,000 wt ppm sulfur; c. feeding the mixed feed to a hydroprocessing unit to produce a heavy API Group II base oil having a kinematic viscosity at 70° C. from 22.6 to 100 $mm^2/s$. An integrated refinery process unit for making heavy base oils, comprising: a. an aromatic extraction unit fluidly connected to a solvent dewaxing unit and a hydroprocessing unit; b. a first line from the aromatic extraction unit, that feeds an aromatic extract to a second hydrocarbon feed to make a mixed feed having greater than 2,000 wt ppm sulfur; and c. a connection that feeds the mixed feed to the hydroprocessing unit.

11 Claims, 15 Drawing Sheets

(51) Int. Cl.

| | |
|---|---|
| ***C10G 67/04*** | (2006.01) |
| ***C10M 101/00*** | (2006.01) |
| ***C10M 177/00*** | (2006.01) |
| ***C10G 53/06*** | (2006.01) |
| ***C10G 73/06*** | (2006.01) |
| *C10G 67/02* | (2006.01) |
| *C10M 101/02* | (2006.01) |

(56) References Cited

U.S. PATENT DOCUMENTS

| | | | | |
|---|---|---|---|---|
| 5,110,445 | A | 5/1992 | Chen et al. | |
| 6,569,313 | B1 | 5/2003 | Carroll et al. | |
| 7,267,758 | B2 | 9/2007 | Benazzi et al. | |
| 2015/0060329 | A1 | 3/2015 | Wedlock | |
| 2015/0068951 | A1 | 3/2015 | Raman et al. | |
| 2015/0275106 | A1* | 10/2015 | Vaughn | C10G 67/02 585/256 |

* cited by examiner

285 °F (140.6 degree Celsius)

PRODUCTION OF HEAVY API GROUP II BASE OIL

TECHNICAL FIELD

This application is directed to a process for producing heavy API Group II base oil, and an integrated refinery process unit that produces heavy API Group I base oil and heavy API Group II base oil.

BACKGROUND

Improved processes and refinery process units for making API Group II base oil from feeds comprising an aromatic extract are needed.

SUMMARY

This application provides a process for heavy base oil production, comprising:

a. performing an aromatic extraction of a first hydrocarbon feed to produce an aromatic extract, and a waxy raffinate for further solvent dewaxing;

b. mixing the aromatic extract with a second hydrocarbon feed to make a mixed feed having greater than 2,000 wt ppm sulfur;

c. feeding the mixed feed to a hydroprocessing unit configured to produce a heavy API Group II base oil having a kinematic viscosity at 70° C. from 22.6 to 100 $mm^2/s$.

This application also provides an integrated refinery process unit for making heavy base oils, comprising:

a. an aromatic extraction unit fluidly connected to:

i. a solvent dewaxing unit configured to produce a heavy API Group I base oil; and ii. a hydroprocessing unit configured to produce a heavy API Group II base oil having a kinematic viscosity at 70° C. from 22.6 to 100 $mm^2/s$;

b. a first line from the aromatic extraction unit, that feeds an aromatic extract from the aromatic extraction unit, to a second hydrocarbon feed in a second line or a vessel, to make a mixed feed having greater than 2,000 wt ppm sulfur; and c. a connection from the second line or the vessel, to the hydroprocessing unit, that feeds the mixed feed to the hydroprocessing unit.

The present invention may suitably comprise, consist of, or consist essentially of, the elements in the claims, as described herein.

GLOSSARY

Figure 1:
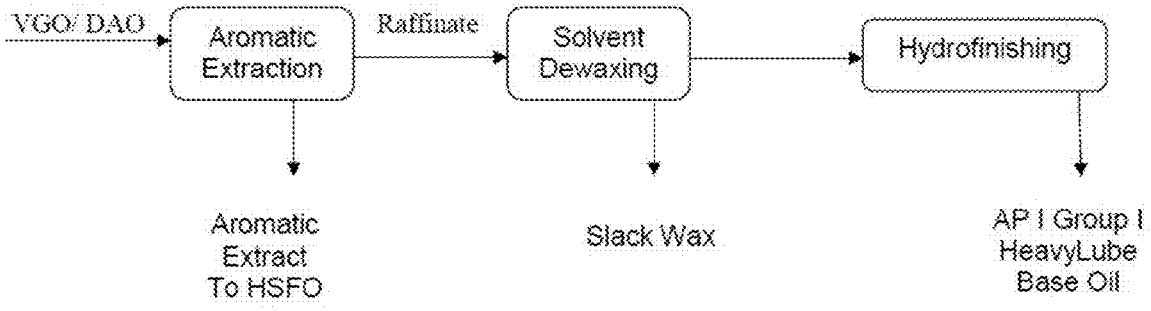
FIG. 1 is a process flow diagram of the traditional process scheme for producing API Group I heavy base oil.

"API Base Oil Categories" are classifications of base oils that meet the different criteria shown in Table 1:

TABLE 1

| API Group | Sulfur, wt % | Saturates, wt % | Viscosity Index |
|---|---|---|---|
| I | >0.03 and/or | <90 | 80-119 |
| II | ≤0.03 and | ≥90 | 80-119 |
| III | ≤0.03 and | ≥90 | ≥120 |
| IV | All Polyalphaolefins (PAOs) | | |
| V | All base oils not included in Groups I-IV(naphthenics, non-PAO synthetics) | | |

"Group II+" is an unofficial, industry-established 'category' that is a subset of API Group II base oils that have a VI greater than 110, usually 112 to 119.

"Heavy sulfur fuel oil" (HSFO) is low value oil having greater than 1 wt % sulfur. It traditionally has been used as a bunker fuel. HFSO has required expensive upgrading and desulfurization for it to be used as a marine fuel due to recent regulations requiring lower sulfur levels.

"Aromatic Extraction" is part of a process used to produce solvent neutral base oils. During aromatic extraction, vacuum gas oil, deasphalted oil, or mixtures thereof are extracted using solvents in a solvent extraction unit. The aromatic extraction creates a waxy raffinate and an aromatic extract, after evaporation of the solvent.

"Vacuum gas oil" (VGO) is a byproduct of crude oil vacuum distillation that can be sent to a hydroprocessing unit or to an aromatic extraction for upgrading into base oils. VGO comprises hydrocarbons with a boiling range distribution between 343° C. (649° F.) and 538° C. (1000° F.) at 0.101 MPa.

"Deasphalted oil" (DAO) refers to the residuum from a vacuum distillation unit that has been solvent deasphalted. Solvent deasphalting in a refinery is described in J. Speight: Synthetic Fuels Handbook, ISBN 007149023X, 2008, pages 64, 85-85, and 121.

"Raffinate" refers to the portion of an original liquid (e.g., VGO or DAO) that remains after other components have been dissolved and removed by a solvent.

"Aromatic Extract" is one of the products from aromatic extraction, after evaporation of the solvent. In the past it has been used as HSFO, as it typically contains greater than 1 wt % sulfur.

"Solvent Dewaxing" is a process of dewaxing by crystallization of paraffins at low temperatures and separation by filtration. Solvent dewaxing produces a dewaxed oil and slack wax. The dewaxed oil can be further hydrofinished to produce base oil.

"Hydroprocessing" refers to a process in which a carbonaceous feedstock is brought into contact with hydrogen and a catalyst, at a higher temperature and pressure, for the purpose of removing undesirable impurities and/or converting the feedstock to a desired product. Examples of hydroprocessing processes include hydrocracking, hydrotreating, catalytic dewaxing, and hydrofinishing.

"Hydrocracking" refers to a process in which hydrogenation and dehydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

"Hydrotreating" refers to a process that converts sulfur- and/or nitrogen-containing hydrocarbon feeds into hydrocarbon products with reduced sulfur and/or nitrogen content, typically in conjunction with a hydrocracking function, and which generates hydrogen sulfide and/or ammonia (respectively) as byproducts.

"Catalytic dewaxing", or hydroisomerization, refers to a process in which normal paraffins are isomerized to their more branched counterparts in the presence of hydrogen and over a catalyst.

"Hydrofinishing" refers to a process that is intended to improve the oxidation stability, UV stability, and appearance of the hydrofinished product by removing traces of aromatics, olefins, color bodies, and solvents. As used in this disclosure, the term UV stability refers to the stability of the hydrocarbon being tested when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487.

"Hydrocarbon" means a compound or substance that contains hydrogen and carbon atoms, but which can include heteroatoms such as oxygen, sulfur or nitrogen.

"Slack Wax" refers to petroleum wax containing anywhere from 3 to 50% oil content.

"Kinematic viscosity" refers to the ratio of the dynamic viscosity to the density of an oil at the same temperature and pressure, as determined by ASTM D445-15.

"Saybolt universal second" (SUS) viscosity is a measure of kinematic viscosity used in classical mechanics. It is the time that 60 $cm^3$ of oil takes to flow through a calibrated tube at a controlled temperature using a Saybolt viscometer. The practice is now obsolete in the industry, but SUS viscosity can be converted from the kinematic viscosity, as determined by ASTM D2161-10.

"Aniline point" of an oil is measured by ASTM D611-12 and is defined as the minimum temperature at which equal volumes of aniline and the oil are miscible, i.e., form a single phase upon mixing. The value for aniline point gives an approximation for the content of aromatic compounds in the oil, since the miscibility of aniline suggests the presence of similar (i.e. aromatic) compounds in the oil. The lower the aniline point, the greater is the content of aromatic compounds in the oil as a lower temperature is needed to ensure miscibility.

"Ultraviolet (UV) absorbance" is a useful measurement for characterizing petroleum products, and can be determined by ASTM D2008-12.

"Heavy base oil" in the context of this disclosure refers to a base oil having a kinematic viscosity at 100° C. greater than 10 $mm^2/s$.

"Bright stock" refers to a heavy base oil having a kinematic viscosity above 180 $mm^2/s$ at 40° C., such as above 250 $mm^2/s$ at 40° C., or possibly ranging from 400 to 1100 $mm^2/s$ at 40° C.

"Cut point" refers to the temperature on a True Boiling Point (TBP) curve at which a predetermined degree of separation is reached.

"TBP" refers to the boiling point of a hydrocarbonaceous feed or product, as determined by Simulated Distillation (SimDist) by ASTM D2887-13.

"Hydrocarbonaceous" means a compound or substance that contains hydrogen and carbon atoms, and which can include heteroatoms such as oxygen, sulfur, or nitrogen.

"LHSV" means liquid hourly space velocity.

"SCF/B" refers to a unit of standard cubic foot of gas (e.g., nitrogen, hydrogen, air, etc) per barrel of hydrocarbonaceous feed.

"Zeolite beta" refers to zeolites having a 3-dimensional crystal structure with straight 12-membered ring channels with crossed 12-membered ring channels, and having a framework density of about 15.3 T/1000 $Å^3$. Zeolite beta has a BEA framework as described in Ch. Baerlocher and L. B. McCusker, Database of Zeolite Structures: http://www.iza-structure.org/databases/

"$SiO_2/Al_2O_3$ mole ratio (SAR) is determined by ICP elemental analysis. A SAR of infinity means there is no aluminum in the zeolite, i.e., the mole ratio of silica to alumina is infinity. In that case, the zeolite is comprised of essentially all silica.

"Zeolite USY" refers to ultra-stabilized Y zeolite. Y zeolites are synthetic faujasite (FAU) zeolites having a SAR of 3 or higher. Y zeolite can be ultra-stabilized by one or more of hydrothermal stabilization, dealumination, and isomorphous substitution. Zeolite USY can be any FAU-type zeolite with a higher framework silicon content than a starting (as-synthesized) Na—Y zeolite precursor.

"Catalyst support" refers to a material, usually a solid with a high surface area, to which a catalyst is affixed.

"Periodic Table" refers to the version of the IUPAC Periodic Table of the Elements dated Jun. 22, 2007, and the numbering scheme for the Periodic Table Groups is as described in Chemical And Engineering News, 63(5), 27 (1985).

"OD acidity" refers to the amount of bridged hydroxyl groups exchanged with deuterated benzene at 80° C. by Fourier transform infrared spectroscopy (FTIR). OD acidity is a measure of the Brønsted acid sites density in a catalyst. The extinction coefficient of OD signals was determined by analysis on a standard zeolite beta sample calibrated with $^1H$ magic-angle spinning nuclear magnetic resonance (MAS NMR) spectroscopy. A correlation between the OD and OH extinction coefficients was obtained as following:

$$\epsilon_{(-OD)}=0.62*\epsilon_{(-OH)}.$$

"Domain Size" is the calculated area, in $nm^2$, of the structural units observed and measured in zeolite beta catalysts. Domains are described by Paul A. Wright et. al., "Direct Observation of Growth Defects in Zeolite Beta", JACS Communications, published on web Dec. 22, 2004. The method used to measure the domain sizes of zeolite beta is further described herein.

"Acid site distribution index (ASDI)" is an indicator of the hyperactive site concentration of a zeolite. In some embodiments, the lower the ASDI the more likely the zeolite will have a greater selectivity towards the production of heavier middle distillate products.

"API gravity" refers to the gravity of a petroleum feedstock or product relative to water, as determined by ASTM D4052-11.

"ISO-VG" refers to the viscosity classification that is recommended for industrial applications, as defined by ISO3448:1992.

"Viscosity index" (VI) represents the temperature dependency of a lubricant, as determined by ASTM D2270-10 (E2011).

"Polycyclic index" (PCI) refers to a calculated value that relates to the amount of polycyclic aromatics that are in a hydrocarbon feed. The test method to determine PCI is ASTM D6379-11.

"Vessel" refers to any container or tube that holds or transports liquids. Examples of vessels are varied and include drums, tanks, pipes, and mixers. Additionally, a vessel may be a process pressure vessel, such as a tower, reactor, or heat exchanger.

DETAILED DESCRIPTION

The aromatic extraction process uses one or more solvents to selectively extract benzene, toluene, and xylene from reformate and the process produces an aromatic extract and a waxy raffinate. In the US, the majority of the commercial aromatic extraction units employ one or more of the following processes:

- UDEX, developed by Dow Chemical, and licensed by Honeywell UOP,
- Tetra (using tetra-ethylene glycol) and CAROM, developed by Union Carbide, and licensed by Linde, and
- Sulfolane™, developed by Royal Dutch Shell, and licensed by Honeywell UOP. A general description of these different aromatic extraction processes is described in http://www.cieng.com/a-111-319-ISBL-Aromatics-Extraction.aspx. In one embodiment, the solvents used for the aromatic extraction are furfural, N-methylpyrrolidone (NMP), or a mixture thereof.

In one embodiment, the waxy raffinate is solvent dewaxed and hydrofinished to produce a heavy API Group I base oil.

In one embodiment, the aromatic extract comprises greater than 20 vol % aromatics, such as from 30 to 80 vol % aromatics, or from 40 to 65 vol % aromatics. In one embodiment, the aromatic extract has one or more properties within the ranges described in Table 2.

TABLE 2

| Property | Aromatic Extract |
|---|---|
| API Gravity | 10-15 |
| Sulfur, wt ppm | 5,000-100,000 |
| Nitrogen, wt ppm | 100-6,000 |

TABLE 2-continued

| Property | Aromatic Extract |
|---|---|
| Carbon, wt % | 80-95 |
| Hydrogen, wt % | 5-20 |
| Aromatics, vol % | 30-80 |
| Naphthenics, vol % | 5-50 |
| Paraffins, vol % | 0-10 |
| S-benzothiophene & dibenzothiophene, vol % | 5-30 |
| Polycyclic Index (PCI) | 2500-10,000 |
| TBP Range, ° F. (° C.) | 700-1400 (371-760) |

The aromatic extract is mixed with the second hydrocarbon feed to make a mixed feed and the mixed feed is fed to the hydroprocessing unit to produce a heavy API Group II base oil having a kinematic viscosity at 70° C. from 22.6 to 100 $mm^2/s$.

The mixed feed has greater than 2,000 wt ppm sulfur, yet is hydroprocessed in a well-configured hydroprocessing unit to make excellent quality heavy API Group II base oil. In one embodiment, the mixed feed can have from greater than 2,000 wt ppm to 40,000 wt ppm sulfur.

In one embodiment, the second hydrocarbon feed can have an initial boiling point from 250° C. to less than 340° C. In one embodiment, the second hydrocarbon feed has an initial boiling point from 300° C. to less than 340° C. to optimize the yield of heavy API Group II base oil that is produced. In one embodiment, the aromatic extract and the second hydrocarbon feed are blended into a mixed feed having an initial boiling point less than 340° C. (644° F.). In one embodiment the mixed feed has an initial boiling point greater than 300° C. (572° F.). For example, in one embodiment, the mixed feed can have an initial boiling point from 300° C. (572° F.) to 339° C. (642° F.).

In one embodiment, the aromatic extract and the second hydrocarbon feed are blended into a mixed feed comprising greater than 3 wt % of the aromatic extract, such as from 5 to 20 wt % of the aromatic extract.

In one embodiment, the hydroprocessing unit performs hydrotreating, catalytic dewaxing, and hydrofinishing. In one embodiment the hydroprocessing unit performs hydrotreating, catalytic dewaxing using a catalytic dewaxing catalyst, and hydrofinishing using a hydrofinishing catalyst.

In one embodiment, the conditions in the hydroprocessing unit include the following:

TABLE 3

| Property | |
|---|---|
| Liquid Hourly Space Velocity (LHSV), $hr^{-1}$ | 0.1-5 |
| $H_2$ partial pressure, psig (kPa) | 800-3,500 (5516-24,132) |
| $H_2$ Consumption Rate, SCF/B | 200-20,000 |
| $H_2$ Recirculation Rate, SCF/B | 50-5,000 |
| Operating Temperature | 200-450° C. (392-842° F.) |
| Conversion <700° F. (371° C.), wt % | 10-90 |

In one embodiment, the operating temperature in the hydroprocessing unit is less than 750° F. (399° C.), such as from 650° F. (343° C.) to 749° F. (398° C.).

In one embodiment, the conditions in the hydroprocessing unit provide a conversion less than 700° F. (371° C.) of from 15 to 35 wt %.

The refining equipment used in the processes described herein can consist of conventional process equipment typically used in commercial refining operations, including aromatic extracting, solvent dewaxing, hydrotreating, hydrocracking, catalytic dewaxing and hydrofinishing units for recovery of product and unconverted feedstock, including caustic scrubbers, flash drums, suction traps, acid washes, fractionators, strippers, separators, distillation columns, and the like.

In one embodiment, the hydroprocessing (e.g., hydrotreating, hydrocracking, catalytic dewaxing, or hydrofinishing stage) can be accomplished using one or more fixed bed reactors or reaction zones within a single reactor each of which can include one or more catalyst beds of the same, or different, hydroprocessing catalysts. Although other types of hydroprocessing catalyst beds can be used, in one embodiment, fixed beds are used. Other types of hydroprocessing catalyst beds suitable for use herein include fluidized beds, ebullated beds, slurry beds, and moving beds.

In one embodiment, inter-stage cooling or heating between reactors or reaction zones, or between catalyst beds in the same reactor or reaction zone, can be employed for the hydroprocessing since the various hydroprocessing reactions can be generally exothermic. A portion of the heat generated during hydroprocessing can be recovered. Where this heat recovery option is not available, conventional cooling may be performed through cooling utilities such as cooling water or air, or through use of a hydrogen quench stream. In this manner, optimum reaction temperatures can be more easily maintained.

In one embodiment the hydrotreating is done in conjunction with hydrocracking using a hydrocracking catalyst in the hydroprocessing unit.

In one embodiment, the process comprises separating stripper bottoms from the effluent of a combined hydrotreating and hydrocracking unit located within the hydroprocessing unit, wherein the combined hydrotreating and hydrocracking unit is operated under hydroprocessing conditions and using one or more hydrocracking catalysts to produce the stripper bottoms having the kinematic viscosity at 70° C. greater than 22.6 $mm^2/s$. In a sub-embodiment, the stripper bottoms separated from the effluent of the combined hydrotreating and hydrocracking unit located within the hydroprocessing unit comprise 1 to 15 lv % aromatic hydrocarbons, 70 to 90 lv % naphthenic carbons, and 1 to 25 lv % paraffinic hydrocarbons.

Hydrocracking Catalyst

In one embodiment, the hydrocracking catalyst comprises at least one hydrocracking catalyst support, one or more metals, optionally one or more molecular sieves, and optionally one or more promoters.

In one sub-embodiment, the hydrocracking catalyst support is selected from the group consisting of alumina, silica, zirconia, titanium oxide, magnesium oxide, thorium oxide, beryllium oxide, alumina-silica, alumina-titanium oxide, alumina-magnesium oxide, silica-magnesium oxide, silica-zirconia, silica-thorium oxide, silica-beryllium oxide, silica-titanium oxide, titanium oxide-zirconia, silica-alumina-zirconia, silica-alumina-thorium oxide, silica-alumina-titanium oxide or silica-alumina-magnesium oxide. In one sub-embodiment the hydrocracking catalyst support is an alumina, a silica-alumina, and combinations thereof.

In another sub-embodiment, the hydrocracking catalyst support is an amorphous silica-alumina material in which the mean mesopore diameter is between 70 Å and 130 Å.

In another sub-embodiment, the hydrocracking catalyst support is an amorphous silica-alumina material containing $SiO_2$ in an amount of 10 to 70 wt % of the bulk dry weight of the hydrocracking catalyst support as determined by ICP elemental analysis, and having a BET surface area of between 450 and 550 $m^2/g$ and a total pore volume of between 0.75 and 1.05 mL/g.

In another sub-embodiment, the hydrocracking catalyst support is an amorphous silica-alumina material containing $SiO_2$ in an amount of 10 to 70 wt % of the bulk dry weight of the hydrocracking catalyst support as determined by ICP elemental analysis, and having a BET surface area of between 450 and 550 $m^2/g$, a total pore volume of between 0.75 and 1.05 mL/g, and a mean mesopore diameter between 70 Å and 130 Å.

In one sub-embodiment, the amount of the hydrocracking catalyst support in the hydrocracking catalyst is from 5 wt % to 80 wt % based on the bulk dry weight of the hydrocracking catalyst.

In one sub-embodiment, the hydrocracking catalyst may optionally contain one or more molecular sieves selected from the group consisting of BEA-, ISV-, BEC-, IWR-, MTW-, *STO-, OFF-, MAZ-, MOR-, MOZ-, AFI-, *NRE, SSY-, FAU-, EMT-, ITQ-21-, ERT-, ITQ-33-, and ITQ-37-type molecular sieves, and mixtures thereof.

In one sub-embodiment, the one or more molecular sieves selected from the group consisting of molecular sieves having a FAU framework topology, molecular sieves having a BEA framework topology, and mixtures thereof.

In one sub-embodiment, the amount of molecular sieve material in the hydrocracking catalyst is from 0 wt % to 60 wt % based on the bulk dry weight of the hydrocracking catalyst. In another sub-embodiment, the amount of molecular sieve material in the hydrocracking catalyst is from 0.5 wt % to 40% wt %.

In one sub-embodiment, the hydrocracking catalyst may optionally contain a non-zeolitic molecular sieve. Examples of non-zeolitic molecular sieves which can be used include silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); U.S. Pat. No. 4,913,799 and the various references cited in U.S. Pat. No. 4,913,799. Mesoporous molecular sieves can also be used, for example the M41S family of materials (J. Am. Chem. Soc., 114:10834 10843(1992)), MCM-41 (U.S. Pat. Nos. 5,246,689; 5,198,203; 5,334,368), and MCM-48 (Kresge et al., Nature 359:710 (1992)).

In one sub-embodiment, the molecular sieve comprises a Y zeolite with a unit cell size of 24.15 Å-24.45 Å. In another sub-embodiment, the molecular sieve comprises a Y zeolite with a unit cell size of 24.15 Å-24.35 Å. In another sub-embodiment, the molecular sieve is a low-acidity, highly dealuminated ultrastable Y zeolite having an Alpha value of less than 5 and a Brønsted acidity of from 1 to 40 micromole/g. In one sub-embodiment, the molecular sieve is a Y zeolite having the properties described in Table 4 below.

TABLE 4

| | |
|---|---|
| Alpha Value | 0.01-5 |
| CI | 0.05-5% |
| Brønsted acidity | 1-40 μmole/g |
| SAR | 80-150 |
| Surface Area | 650-750 $m^2/g$ |
| Micropore Volume | 0.25-0.30 mL/g |
| Total Pore Volume | 0.51-0.55 mL/g |
| Unit Cell Size | 24.15-24.35 Å |

In another sub-embodiment, the molecular sieve comprises a Y zeolite having the properties described in Table 5 below.

TABLE 5

| | |
|---|---|
| SAR | 10-∞ |
| Micropore Volume | 0.15-0.27 mL/g |
| BET Surface Area | 700-825 $m^2/g$ |
| Unit Cell Size | 24.15-24.45 Å |

In another sub-embodiment, the hydrocracking catalyst contains from 0.1 wt. % to 40 wt. % (based on the bulk dry weight of the catalyst) of a Y zeolite having the properties described Table 4 above, and from 1 wt. % to 60 wt. % (based on the bulk dry weight of the catalyst) of a low-acidity, highly dealuminated ultrastable Y zeolite having an Alpha value of less than about 5 and a Brønsted acidity of from 1 to 40 micro-mole/g.

In another sub-embodiment, the hydrocracking catalyst comprises a zeolite USY having an ASDI between 0.05 and 0.12.

In another sub-embodiment, the hydrocracking catalyst comprises from 0.5 to 10 wt % zeolite beta having an OD acidity of 20 to 400 μmol/g and an average domain size from 800 to 1500 $nm^2$. The average domain size is determined by a combination of transmission electron (TEM) and digital image analysis, as follows:

I. Zeolite Beta Sample Preparation:

The zeolite beta sample is prepared by embedding a small amount of the zeolite beta in an epoxy and microtoming. The description of suitable procedures can be found in many standard microscopy text books.

Step 1. A small representative portion of the zeolite beta powder is embedded in epoxy. The epoxy is allowed to cure.

Step 2. The epoxy containing a representative portion of the zeolite beta powder is microtomed to 80-90 nm thick. The microtome sections are collected on a 400 mesh 3 mm copper grid, available from microscopy supply vendors.

Step 3. A sufficient layer of electrically-conducting carbon is vacuum evaporated onto the microtomed sections to prevent the zeolite beta sample from charging under the electron beam in the TEM.

II. TEM Imaging:

Step 1. The prepared zeolite beta sample, as described above, is surveyed at low magnifications, e.g., 250,000-1,000,000× to select a crystal in which the zeolite beta channels can be viewed.

Step 2. The selected zeolite beta crystals are tilted onto their zone axis, focused to near Scherzer defocus, and an image was recorded≥2,000,000×.

III. Image Analysis to Obtain Average Domain Size ($nm^2$):

Step 1. The recorded TEM digital images described previously are analyzed using commercially available image analysis software packages.

Step 2. The individual domains are isolated and the domain sizes are measured in $nm^2$. The domains where the projection are not clearly down the channel view are not included in the measurements.

Step 3. A statistically relevant number of domains are measured. The raw data is stored in a computer spreadsheet program.

Step 4. Descriptive statistics, and frequencies are determined—The arithmetic mean ($d_{av}$), or average domain size, and the standard deviation (s) are calculated using the following equations:

The average domain size, $d_{av}=(\text{å}\ n_i d_i)/(\text{å}\ n_i)$

The standard deviation, $s=(\text{å}(d_i-d_{av})^2/(\text{å}\ n_i))^{1/2}$

In one sub-embodiment the average domain size of the zeolite beta is from 900 to 1250 $nm^2$, such as from 1000 to 1150 $nm^2$.

In one embodiment, the hydrocracking catalyst contains one or more metals. In one embodiment, the one or metals are selected from the group consisting of elements from Group 6 and Groups 8 through 10 of the Periodic Table, and mixtures thereof. In one sub-embodiment, each metal is selected from the group consisting of nickel (Ni), cobalt (Co), iron (Fe), chromium (Cr), molybdenum (Mo), tungsten (W), and mixtures thereof. In another sub-embodiment, the hydroprocessing catalyst contains at least one Group 6 metal and at least one metal selected from Groups 8 through 10 of the Periodic Table. Exemplary metal combinations include Ni/Mo/W, Ni/Mo, Ni/W, Co/Mo, Co/W, Co/W/Mo, Ni/Co/W/Mo, and Pt/Pd.

In one sub-embodiment, the total amount of metal oxide material in the hydrocracking catalyst is from 0.1 wt. % to 90 wt. % based on the bulk dry weight of the hydrocracking catalyst. In one sub-embodiment, the hydrocracking catalyst contains from 2 wt. % to 10 wt. % of nickel oxide and from 8 wt. % to 40 wt. % of tungsten oxide based on the bulk dry weight of the hydrocracking catalyst.

In one sub-embodiment, a diluent may be employed in the formation of the hydrocracking catalyst. Suitable diluents include inorganic oxides such as aluminum oxide and silicon oxide, titanium oxide, clays, ceria, and zirconia, and mixture of thereof. In one sub-embodiment, the amount of diluent in the hydrocracking catalyst is from 0 wt. % to 35 wt. % based on the bulk dry weight of the hydrocracking catalyst. In one sub-embodiment, the amount of diluent in the hydrocracking catalyst is from 0.1 wt % to 25 wt % based on the bulk dry weight of the hydrocracking catalyst.

In one sub-embodiment, the hydrocracking catalyst can contain one or more promoters selected from the group consisting of phosphorous (P), boron (B), fluorine (F), silicon (Si), aluminum (Al), zinc (Zn), manganese (Mn), and mixtures thereof. In one sub-embodiment, the amount of promoter in the hydrocracking catalyst is from 0 wt. % to 10 wt. % based on the bulk dry weight of the hydrocracking catalyst. In one sub-embodiment, the amount of promoter in the hydrocracking catalyst is from 0.1 wt % to 5 wt % based on the bulk dry weight of the hydrocracking catalyst.

In one embodiment, the hydroprocessing conditions for a first or second hydrocracking stage are as follows: the overall liquid hourly space velocity (LHSV) is about 0.25 to 4.0 $hr^{-1}$, such as about 0.40 to 3.0 $hr^{-1}$; the hydrogen partial pressure is greater than 200 psig, such as from 500 to 3000 psig; hydrogen re-circulation rates are greater than 500 SCF/B, such as between 1000 and 7000 SCF/B; and temperatures range from 600° F. (316° C.) to 850° F. (454° C.), such as from 700° F. (371° C.) to 850° F. (454° C.).

Catalytic Dewaxing Catalysts

In one embodiment, catalysts used in carrying out the catalytic dewaxing process include at least one dewaxing catalyst support, one or more noble metals, one or more molecular sieves, and optionally one or more promoters.

In one sub-embodiment, the dewaxing catalyst support is selected from the group consisting of alumina, silica, zirconia, titanium oxide, magnesium oxide, thorium oxide, beryllium oxide, alumina-silica, alumina-titanium oxide, alumina-magnesium oxide, silica-magnesium oxide, silica-zirconia, silica-thorium oxide, silica-beryllium oxide, silica-titanium oxide, titanium oxide-zirconia, silica-alumina-zirconia, silica-alumina-thorium oxide, silica-alumina-titanium oxide or silica-alumina-magnesium oxide, preferably alumina, silica-alumina, and combinations thereof.

In one sub-embodiment, the dewaxing catalyst support is an amorphous silica-alumina material in which the mean mesopore diameter is between 70 Å and 130 Å.

In another sub-embodiment, the dewaxing catalyst support is an amorphous silica-alumina material containing $SiO_2$ in an amount of 10 to 70 wt. % of the bulk dry weight of the dewaxing catalyst support as determined by ICP elemental analysis, a BET surface area of between 450 and 550 $m^2/g$ and a total pore volume of between 0.75 and 1.05 mL/g In another sub-embodiment, the dewaxing catalyst support is an amorphous silica-alumina material containing $SiO_2$ in an amount of 10 to 70 wt % of the bulk dry weight of the dewaxing catalyst support as determined by ICP elemental analysis, and having a BET surface area of between 450 and 550 $m^2/g$, a total pore volume of between 0.75 and 1.05 mL/g, and a mean mesopore diameter between 70 Å and 130 Å.

In one sub-embodiment, the amount of dewaxing catalyst support in the catalytic dewaxing catalyst is from 5 wt % to 80 wt % based on the bulk dry weight of the catalytic dewaxing catalyst.

In one embodiment, the catalytic dewaxing catalyst may optionally contain one or more molecular sieves selected from the group consisting of SSZ-32, small crystal SSZ-32 (SSZ-32x), SSZ-91, ZSM-23, ZSM-48, EU-2, MCM-22, ZSM-5, ZSM-12, ZSM-22, ZSM-35 and MCM-68-type molecular sieves, and mixtures thereof. SSZ-91 is described in U.S. patent application Ser. No. 14/837,071, filed on Aug. 27, 2015. In one embodiment, the catalytic dewaxing catalyst may optionally contain a non-zeolitic molecular sieve. Examples of non-zeolitic molecular sieves which can be used include silicoaluminophosphates (SAPO), ferroaluminophosphate, titanium aluminophosphate and the various ELAPO molecular sieves described earlier.

In one embodiment, the amount of molecular sieve material in the catalytic dewaxing catalyst can be from 0 wt % to 80 wt % based on the bulk dry weight of the catalytic dewaxing catalyst. In one sub-embodiment, the amount of molecular sieve material in the catalytic dewaxing catalyst is from 0.5 wt % to 40% wt %. In one sub-embodiment, the amount of the molecular sieve material in the catalytic dewaxing catalyst is from 35 wt % to 75 wt %. In one sub-embodiment, the amount of the molecular sieve material in the catalytic dewaxing catalyst is from 45 wt % to 75 wt %.

In one embodiment, the catalytic dewaxing catalyst contains one or more noble metals selected from the group consisting of elements from Group 10 of the Periodic Table, and mixtures thereof. In one sub-embodiment, each noble metal is selected from the group consisting of platinum (Pt), palladium (Pd), and mixtures thereof.

Hydrofinishing Catalyst

In one embodiment, a hydrofinishing catalyst used in carrying out a hydrofinishing process includes at least one hydrofinishing catalyst support, one or more metals, and optionally one or more promoters.

In one sub-embodiment, the hydrofinishing catalyst support can be selected from the group consisting of alumina, silica, zirconia, titanium oxide, magnesium oxide, thorium oxide, beryllium oxide, alumina-silica, alumina-titanium oxide, alumina-magnesium oxide, silica-magnesium oxide, silica-zirconia, silica-thorium oxide, silica-beryllium oxide, silica-titanium oxide, titanium oxide-zirconia, silica-alumina-zirconia, silica-alumina-thorium oxide, silica-alumina-titanium oxide or silica-alumina-magnesium oxide. In one sub-embodiment, the hydrofinishing catalyst support is an alumina, a silica-alumina, and combinations thereof.

In one sub-embodiment, the hydrofinishing catalyst support is an amorphous silica-alumina material in which the mean mesopore diameter is between 70 Å and 130 Å.

In another sub-embodiment, the hydrofinishing catalyst support is an amorphous silica-alumina material containing $SiO_2$ in an amount of 10 to 70 wt % of the bulk dry weight of the hydrofinishing catalyst support as determined by ICP elemental analysis, and having a BET surface area of between 450 and 550 $m^2/g$ and a total pore volume of between 0.75 and 1.05 mL/g.

In another sub-embodiment, the hydrofinishing catalyst support is an amorphous silica-alumina material containing $SiO_2$ in an amount of 10 to 70 wt % of the bulk dry weight of the hydrofinishing catalyst support as determined by ICP elemental analysis, and having a BET surface area of between 450 and 550 $m^2/g$, a total pore volume of between 0.75 and 1.05 mL/g, and a mean mesopore diameter between 70 Å and 130 Å.

In one embodiment, the amount of hydrofinishing catalyst support in the hydrofinishing catalyst is from 5 wt % to 80 wt % based on the bulk dry weight of the hydrofinishing catalyst. In one embodiment, the hydrofinishing catalyst may contain one or more metals selected from the group consisting of elements from Group 6 and Groups 8 through 10 of the Periodic Table, and mixtures thereof. In one sub-embodiment, each metal is selected from the group consisting of nickel (Ni), cobalt (Co), iron (Fe), chromium (Cr), molybdenum (Mo), tungsten (W), and mixtures thereof. In another sub-embodiment, the hydrofinishing catalyst contains at least one Group 6 metal and at least one metal selected from Groups 8 through 10 of the Periodic Table. Exemplary metal combinations in the hydrofinishing catalyst include Ni/Mo/W, Ni/Mo, Ni/W, Co/Mo, Co/W, Co/W/Mo, Ni/Co/W/Mo, and Pt/Pd.

In one sub-embodiment, the total amount of metal oxide material in the hydrofinishing catalyst is from 0.1 wt % to 90 wt % based on the bulk dry weight of the hydrofinishing catalyst. In one sub-embodiment, the hydrofinishing catalyst contains from 2 wt % to 10 wt % of nickel oxide and from 8 wt % to 40 wt % of tungsten oxide based on the bulk dry weight of the hydrofinishing catalyst.

In one embodiment, a diluent may be employed in the formation of the hydrofinishing catalyst. Suitable diluents include inorganic oxides such as aluminum oxide and silicon oxide, titanium oxide, clays, ceria, and zirconia, and mixture of thereof. In one sub-embodiment, the amount of diluent in the hydrofinishing catalyst can be from 0 wt % to 35 wt % based on the bulk dry weight of the hydrofinishing catalyst. In one sub-embodiment, the amount of diluent in the hydrofinishing catalyst is from 0.1 wt % to 25 wt % based on the bulk dry weight of the hydrofinishing catalyst.

In one sub-embodiment the hydrofinishing catalyst can contain one or more promoters selected from the group consisting of phosphorous (P), boron (B), fluorine (F), silicon (Si), aluminum (Al), zinc (Zn), manganese (Mn), and mixtures thereof. In one sub-embodiment, the amount of promoter in the hydrofinishing catalyst can be from 0 wt % to 10 wt % based on the bulk dry weight of the hydrofinishing catalyst. In one sub-embodiment, the amount of promoter in the hydrofinishing catalyst is from 0.1 wt % to 5 wt % based on the bulk dry weight of the hydrofinishing catalyst.

In one sub-embodiment, the hydrofinishing catalyst is a bulk metal or multi-metallic catalyst wherein the amount of metal in the hydrofinishing catalyst is 30 wt % or greater, based on the bulk dry weight of the hydrofinishing catalyst.

Base Oil Product

The heavy API Group II base oil has a kinematic viscosity at 70° C. from 22.6 to 100 $mm^2/s$.

In one embodiment, the heavy API Group II base oil has a VI less than 130. In one embodiment, the heavy API Group II base oil has a VI of 100 to 120. In a sub-embodiment, the heavy API Group II base oil has a VI of 106 to 116.

In one embodiment, the API Group II base oil has less than 10 wt ppm nitrogen. In one embodiment, the heavy API Group II base oil has less than 3 wt ppm nitrogen. For example, in one embodiment, the heavy API Group II base oil can have from zero to 3 wt ppm nitrogen. In different sub-embodiments, the heavy API Group II base oil has less than 1 wt ppm nitrogen and has a VI less than 116, or the heavy API Group II base oil has from 1 to 2 wt ppm nitrogen and has a VI less than 110.

In one embodiment, the API Group II base oil has an aniline point less than 285° F. (140.6° C.). In one embodiment, the heavy API Group II base oil has an aniline point less than 270° F. (132.2° C.), such as from 250 to 270° F. (121.1 to 132.2° C.). In a sub-embodiment, the heavy API Group II base oil has less than 1.5 wt ppm nitrogen and an aniline point less than 260° F. (126.7° C.).

In one embodiment, the heavy API Group II base oil has excellent utility for industrial oils. For industrial oils the reference temperature of 40° C. represents the operating temperature in machinery and the industrial oil can be assigned an ISO-VG classification. Each subsequent Viscosity grade (VG) within the ISO-VG classification has approximately a 50% higher viscosity, whereas the minimum and maximum values of each grade ranges±10% from the midpoint. For example, ISO-VG 22 refers to a viscosity grade of 22 $mm^2/s$±10% at 40° C. The viscosity at different temperatures can be calculated using the viscosity at 40° C. and the viscosity index (VI), which represents the temperature dependency of the lubricant. Table 6 shows the ranges of kinematic viscosity at 40° C. for the different ISO-VG classifications.

TABLE 6

| ISO 3448 | Kinematic Viscosity at 40° C. $mm^2/s$ | | |
|---|---|---|---|
| Viscosity Classification | Mid-point | Minimum | Maximum |
| ISO-VG 2 | 2.2 | 1.98 | 2.42 |
| ISO-VG 3 | 3.2 | 2.88 | 3.52 |
| ISO-VG 5 | 4.6 | 4.14 | 5.06 |
| ISO-VG 7 | 6.8 | 6.12 | 7.48 |
| ISO-VG 10 | 10 | 9.0 | 11.0 |
| ISO-VG 15 | 15 | 13.5 | 16.5 |
| ISO-VG 22 | 22 | 19.8 | 24.2 |
| ISO-VG 32 | 32 | 28.8 | 35.2 |
| ISO-VG 46 | 46 | 41.4 | 50.6 |
| ISO-VG 68 | 68 | 61.2 | 74.8 |
| ISO-VG 100 | 100 | 90 | 110 |
| ISO-VG 150 | 150 | 135 | 165 |
| ISO-VG 220 | 220 | 198 | 242 |
| ISO-VG 320 | 320 | 288 | 352 |
| ISO-VG 460 | 460 | 414 | 506 |
| ISO-VG 680 | 680 | 612 | 748 |
| ISO-VG 1000 | 1000 | 900 | 1100 |
| ISO-VG 1500 | 1500 | 1350 | 1650 |

In one embodiment, the process for base oil production further comprises distilling the heavy API Group II base oil to produce a bright stock. In a sub-embodiment, the bright stock can have an ISO-VG of ISO-VG 320 or ISO-VG 460.

Integrated Refinery Process Unit

Figure 2:
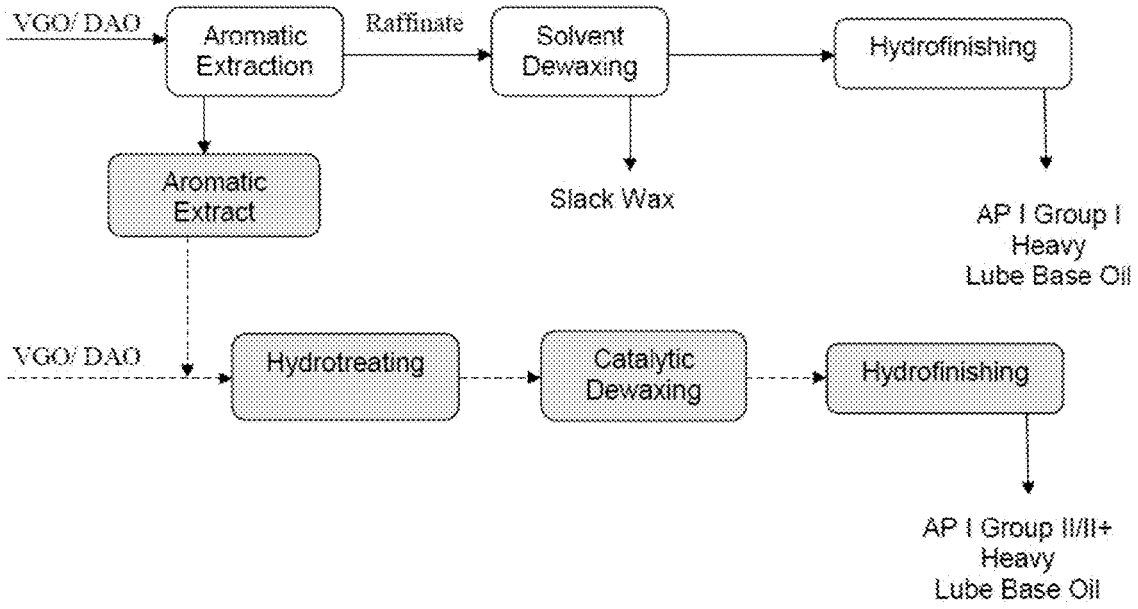
FIG. 2 is a process flow diagram of an improved integrated refinery process unit for making heavy base oils; including heavy API Group II base oil and heavy API Group I base oil.
Figure 3:
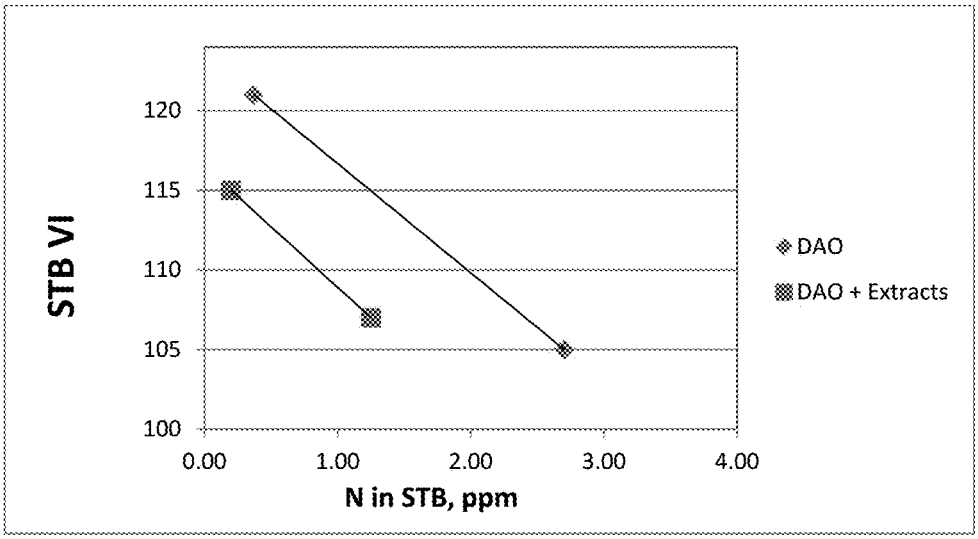
FIG. 3 is a chart of the viscosity indexes of the stripper bottom (STB) products made by the processes of this invention
Figure 4:
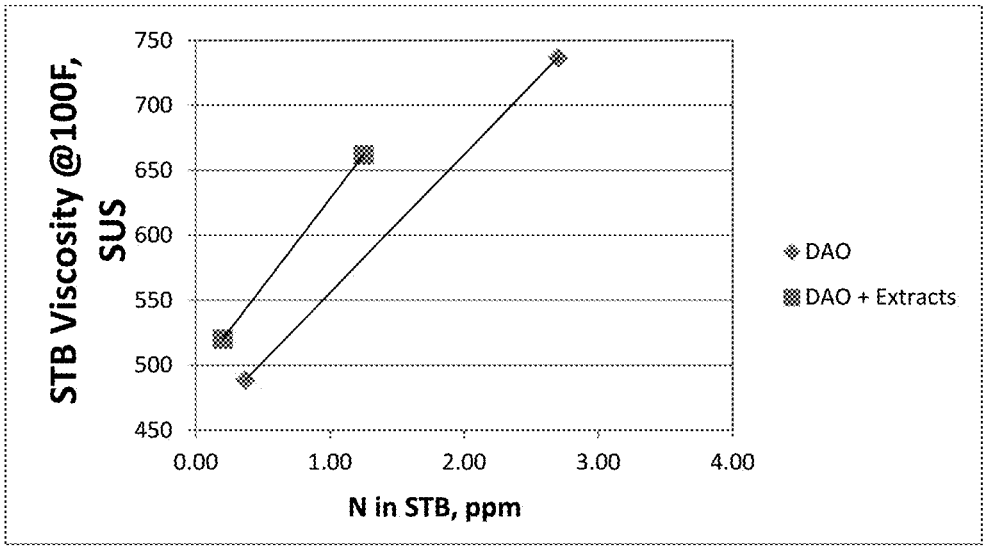
FIG. 4 is a chart of the SUS viscosity at 100° F. (37.78 degree Celsius) of the stripper bottom products made by the processes of this invention.
Figure 5:
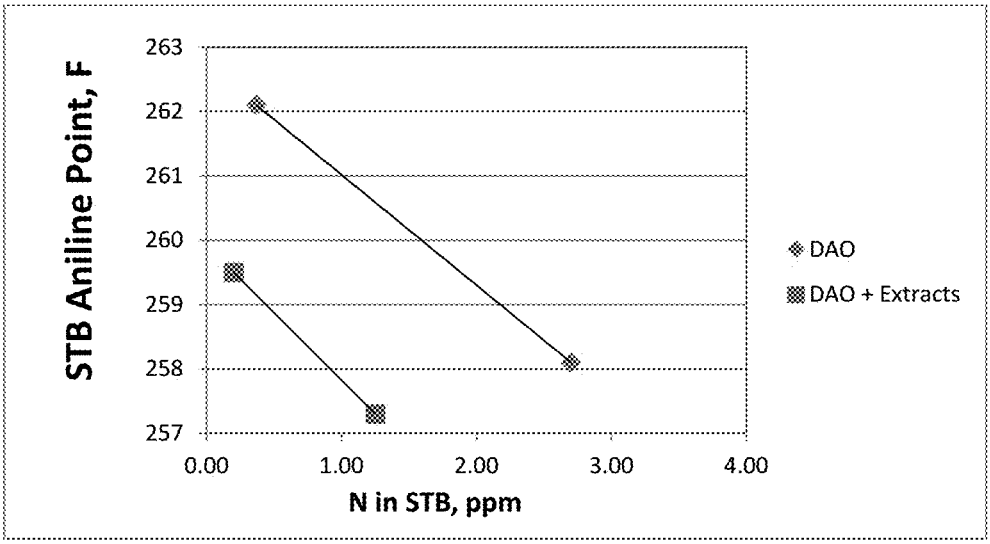
FIG. 5 is a chart of the aniline points of the stripper bottom products made by the processes of this invention.

An example of an embodiment of an integrated refinery process unit is shown in FIG. 2. The integrated refinery process unit makes heavy base oils and comprises an aromatic extraction unit fluidly connected to both a solvent dewaxing unit producing a heavy API Group I base and to a hydroprocessing unit producing a heavy API Group II base oil having a kinematic viscosity at 70° C. from 22.6 to 100 $mm^2/s$. In this embodiment, the integrated refinery process unit has a line from the aromatic extraction unit that feeds an aromatic extract from the aromatic extraction unit to another line feeding a second hydrocarbon feed to make a mixed feed. The mixed feed is fed to the hydroprocessing unit. The mixed feed that is fed to the hydroprocessing unit has greater than 2,000 wt ppm sulfur.

In one embodiment, the hydroprocessing unit in the integrated refinery process unit comprises a hydrotreating unit, a catalytic dewaxing unit, and a hydrofinishing unit. The hydroprocessing conditions and the catalysts used in these units are as described previously in this disclosure.

In one embodiment, a combined hydrotreating and hydrocracking unit is located within the hydroprocessing unit. In a sub-embodiment the combined hydrotreating and hydrocracking unit is configured to operate under hydroprocessing conditions and contains one or more hydrocracking catalysts, such that the combined hydrotreating and hydrocracking unit produces stripper bottoms having the kinematic viscosity at 70° C. from 22.6 to 100 $mm^2/s$. In another sub-embodiment, the combined hydrotreating and hydrocracking unit can be configured to produce stripper bottoms comprising 1 to 15 lv % aromatic hydrocarbons, 70 to 90 lv % naphthenic carbons, and 1 to 25 lv % paraffinic hydrocarbons.

Solvent Dewaxing

As described previously, in one embodiment, the waxy raffinate is solvent dewaxed and hydrofinished to produce a heavy API Group I base oil.

Solvent dewaxing to make base oils has been used for over 70 years and is described, for example, in Chemical Technology of Petroleum, 3rd Edition, William Gruse and Donald Stevens, McGraw-Hill Book Company, Inc., New York, 1960, pages 566 to 570. The basic process for solvent dewaxing, when used, involves:

- mixing a waxy hydrocarbon stream with a solvent,
- chilling the mixture to cause wax crystals to precipitate,
- separating the wax by filtration, typically using rotary drum filters,
- recovering the solvent from the wax and the dewaxed oil filtrate.

In one embodiment, the solvent used for the solvent dewaxing can be recycled to the solvent dewaxing process. Suitable solvents for solvent dewaxing can comprise, for example, a ketone (such as methyl ethyl ketone or methyl iso-butyl ketone) and an aromatic (such as toluene). Other types of suitable solvents are C3-C6 ketones (e.g. methyl ethyl ketone, methyl isobutyl ketone and mixtures thereof), C6-C10 aromatic hydrocarbons (e.g. toluene), mixtures of ketones and aromatics (e.g. methyl ethyl ketone and toluene), auto-refrigerative solvents such as liquefied, normally gaseous C2-C4 hydrocarbons such as propane, propylene, butane, butylene and mixtures thereof. A mixture of methyl ethyl ketone and methyl isobutyl ketone can also be used.

There have been refinements in solvent dewaxing since its inception. For example, Exxon's DILCHILL® dewaxing process involves cooling a waxy hydrocarbon oil stock in an elongated stirred vessel, preferably a vertical tower, with a pre-chilled solvent that will solubilize at least a portion of the oil stock while promoting the precipitation of the wax. Waxy oil is introduced into the elongated staged cooling zone or tower at a temperature above its cloud point. Cold dewaxing solvent is incrementally introduced into the cooling zone along a plurality of points or stages while maintaining a high degree of agitation therein to effect substantially instantaneous mixing of the solvent and wax/oil mixture as they progress through the cooling zone, thereby precipitating at least a portion of the wax in the oil. DILCHILL® dewaxing is discussed in greater detail in the U.S. Pat. Nos. 4,477,333, 3,773,650, and 3,775,288. Texaco also has developed refinements in the process. For example, U.S. Pat. No. 4,898,674 discloses how it is important to control the ratio of methyl ethyl ketone (MEK) to toluene and to be able to adjust this ratio, since it allows use of optimum concentrations for processing various base stocks. Commonly, a ratio of 0.7:1 to 1:1 may be used when processing bright stocks; and a ratio of 1.2:1 to about 2:1 may be used when processing light stocks.

In one embodiment the waxy raffinate can be chilled to a temperature in the range of from −10° C. to −40° C., or in the range of from −20° C. to −35° C., to cause wax crystals to precipitate. The precipitated wax crystals can be separating by filtration. The filtration can use a filter comprising a filter cloth which can be made of any suitable material, including: textile fibers, such as cotton; porous metal cloth; or cloth made of synthetic materials.

In one embodiment, the solvent dewaxing conditions will include that amount of solvent that when added to the waxy raffinate will be sufficient to provide a liquid/solid weight ratio of about 5:1 to about 20:1 at the dewaxing temperature and a solvent/waxy raffinate volume ratio between 1.5:1 to 5:1.

EXAMPLES

Example 1

Aromatic Extract

A sample of aromatic extract from a refinery used to produce Group I heavy base oil, as shown in FIG. 1 was obtained and analyzed. The properties of this aromatic extract were as follows:

TABLE 7

| Property | Aromatic Extract |
|---|---|
| API Gravity | 13.6 |
| Sulfur, wt ppm | 30200 |
| Nitrogen, wt ppm | 2900 |
| Carbon, wt % | 87.0 |
| Hydrogen, wt % | 11.7 |
| Aromatics, vol % | 52.4 |
| Naphthenics, vol % | 30.2 |
| Paraffins, vol % | 1.0 |
| S-benzothiophene & dibenzothiophene, vol % | 16.4 |
| Polycyclic Index (PCI) | 4103 |
| UV, 226 nm, au | 39.8 |
| UV, 255 nm, au | 24.5 |
| UV, 272 nm, au | 20.6 |
| UV, 305 nm, au | 8.7 |
| UV, 310 nm, au | 7.2 |

TABLE 7-continued

| Property | Aromatic Extract |
|---|---|
| SimDist, wt %, ° F. | |
| 0.5/5 | 727/813 |
| 10/30 | 837/899 |
| 50 | 959 |
| 70/90 | 1021/1099 |
| 95/99.5 | 1141/1301 |
| Wt % <700° F. | 0.0 |

Example 2

Deasphalted Oil and Blend of Deasphalted Oil with Aromatic Extract

A sample of typical deasphalted oil with a VI of 90 from a refinery was obtained and blended with 10 vol % of the aromatic extract described in Example 1. The properties of these two sample feeds are described below:

TABLE 8

| Property | Deasphalted Oil | Blend of Deasphalted Oil with Aromatic Extract |
|---|---|---|
| API Gravity | 20.2 | 19.2 |
| Sulfur, wt ppm | 21500 | 22400 |
| Nitrogen, wt ppm | 1005 | 1200 (calculated) |
| Carbon, wt % | 85.6 | 85.7 |
| Hydrogen, wt % | 13.1 | 13.2 |
| Aromatics, vol % | 34.0 | 36.4 |
| Naphthenics, vol % | 40.9 | 43.5 |
| Paraffins, vol % | 8.5 | 5.0 |
| Sulfur-benzothiophenes & dibenzothiophenes, vol % | 16.6 | 15.1 |
| Polycyclic Index (PCI) | 1822 | 2218 |
| Viscosity (70° C.), cps | 77.0 | 82.1 |
| UV, 226 nm, au | 21.4 | 24.0 |
| UV, 255 nm, au | 12.9 | 14.5 |
| UV, 272 nm, au | 10.8 | 12.3 |
| UV, 305 nm, au | 4.6 | 5.2 |
| UV, 310 nm, au | 3.7 | 4.3 |
| Molecular Weight | 498 | 536 |
| SimDist, wt %, ° F. (° C.) | | |
| 0.5/5 | 619 (326)/788 (420) | 633 (334)/791 (422) |
| 10/30 | 838 (448)/938 (503) | 838 (448)/934 (501) |
| 50 | 1004 (540) | 1000 (538) |
| 70/90 | 1071 (577)/1162 (628) | 1067 (575)/1162 (628) |
| 95/99.5 | 1199/1267 | 1206/1311 |
| Wt % <700° F. | 1.0 | 0.8 |

Example 3

Hydroprocessing of Deasphalted Oil and Blend of Deasphalted Oil with Aromatic Extract The two sample feeds described in Example 2 were hydroprocessed in a two-reactor microunit. The first hydrotreating reactor contained a high activity ISOTREATING® catalyst used as a pre-treat for base oil manufacturing. The second reactor contained a layered catalyst system comprising the same ISOTREATING® catalyst at the top and a high performance ISOCRACKING® catalyst at the bottom. ISOTREATING® and ISOCRACKING® are registered trademarks owned by Chevron Intellectual Property LLC. The second reactor was packed with −100 mesh alundum (a hard material composed of fused alumina) to prevent bypassing and channeling. All of the catalysts were supplied by Advanced Refining Technologies, a joint venture between W.R. Grace and Chevron.

The two-reactor microunit was pre-sulfided, heat-treated, and de-edged by pre-feeding with diesel. The hydroprocessing of the two sample feeds described in Example 2 was done using the following process conditions:

0.50 $hr^{-1}$ LHSV 2350 psig total pressure (2260 psi inlet $H_2$ partial pressure)

5000 SCF/B once-through $H_2$

708° F. (376° C.) to 725° F. (385° C.) reactor temperature

Conversion <700° F. (371° C.) from 19.63 to 32.13 wt %.

The effluents from the two-reactor microunit were passed to a stripper having a cut point at about 743° F. (about 395° C.) which separated and collected the stripper bottom products boiling in the range suitable for base oil production. The process conditions for the hydroprocessing were adjusted during each run to produce stripper bottom products having either a low nitrogen level of 0.1 to 0.4 wppm, or a high nitrogen level of 1.25 to 2.7 wppm.

Some of the average properties that were measured on the stripper bottom products collected from these hydroprocessing runs are shown in Table 9, and charted in FIGS. 3-11. The yields of various hydrocarbon cuts in the effluent from these hydroprocessing runs are shown in Table 10, and charted in FIGS. 12-15.

TABLE 9

| Property | Deasphalted Oil at Low N (Run Temp = 720° F.) | Deasphalted Oil at High N (Run Temp = 708° F.) | Blended Oil at Low N (Run Temp = 725° F.) | Blended Oil at High N (Run Temp = 715° F.) |
|---|---|---|---|---|
| VI | 121 | 105 | 115 | 107 |
| Kinematic Viscosity at 100° C., $mm^2/s$ | 12.15 | 14.82 | 12.34 | 13.9 |
| Kinematic Viscosity at 70° C., $mm^2/2$ | 28.33 | 37.33 | 29.24 | 34.44 |
| API Gravity | 30.7 | 28.7 | 30.2 | 29.0 |
| Aniline Point, ° F. | 262.1 | 258.1 | 259.5 | 257.3 |

TABLE 10

| No Loss Yields, wt % | Deasphalted Oil at Low N (Run Temp = 720° F.) | Deasphalted Oil at High N (Run Temp = 708° F.) | Blended Oil at Low N (Run Temp = 725° F.) | Blended Oil at High N (Run Temp = 715° F.) |
|---|---|---|---|---|
| Methane | 0.13 | 0.10 | 0.15 | 0.11 |
| Ethane | 0.15 | 0.11 | 0.17 | 0.12 |
| Propane | 0.23 | 0.18 | 0.27 | 0.21 |
| i-Butane | 0.15 | 0.09 | 0.12 | 0.10 |
| n-Butane | 0.29 | 0.18 | 0.25 | 0.27 |
| C5-180° F. | 1.74 | 0.85 | 1.19 | 0.88 |
| 180-250° F. | 1.89 | 0.91 | 1.33 | 1.05 |
| 250-550° F. | 15.47 | 8.95 | 13.31 | 9.99 |
| 550-700° F. | 12.44 | 8.89 | 11.48 | 9.8 |
| 700-950° F. | 34.36 | 35.64 | 36.23 | 36.24 |
| 950° F.+ | 32.54 | 43.16 | 33.6 | 39.18 |

Only slightly higher reactor temperatures (by 5 to 7° F.) were needed to achieve the same nitrogen levels in the stripper bottom products when the deasphalted oil with aromatic extract was hydroprocessed compared to when the deasphalted oil was hydroprocessed alone. All of the stripper bottom products would be excellent feeds for further catalytic dewaxing and distillation into desirable Group II base oils, including Group II or Group II+ bright stock. The bright stocks that would be made by the further catalytic dewaxing and distillation of the stripper bottom products made from the blend of deasphalted oil and aromatic extract would also have the desired kinematic viscosity at 40° C. (e.g., ISO-VG 320 or ISO-VG 460) that is currently in short supply in the marketplace, due to their VIs being in a moderate range from 106 to 116. Prior processes making API Group II+ or API Group III bright stocks have made base oils with higher VIs that were in ISO-VG ranges that were too low for many industrial oil applications.

Figure 12:
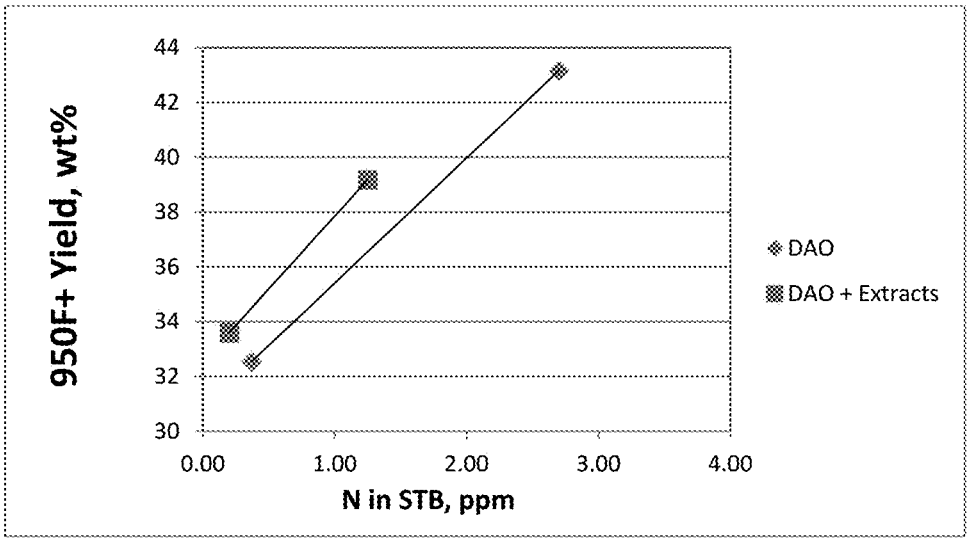
FIG. 12 is a chart of the yields of stripper bottom products that boil at 950° F. (510° C.) or higher, made by the processes of this invention.
Figure 13:
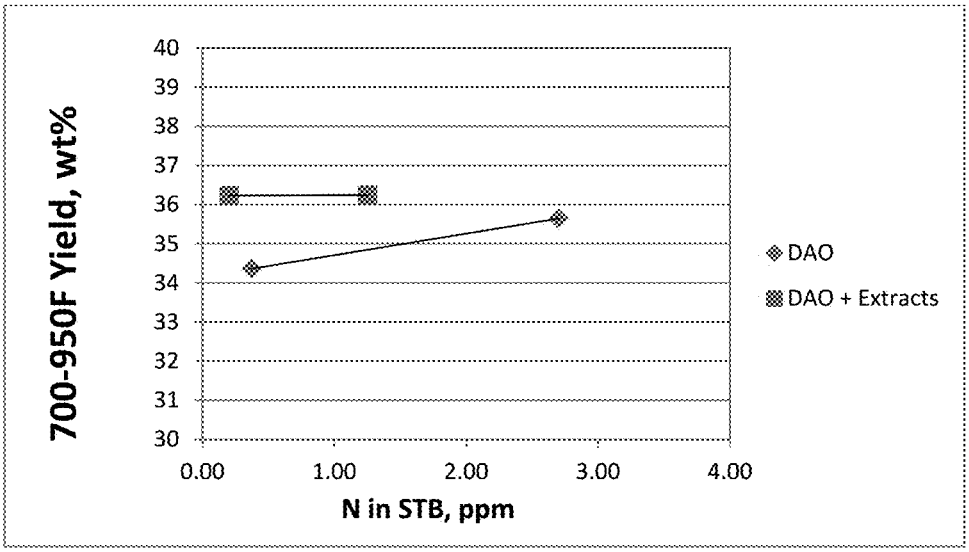
FIG. 13 is a chart of the yields of stripper bottom products that boil in the range of 700 to 950° F. (371 to 510° C.), made by the processes of this invention.
Figure 14:
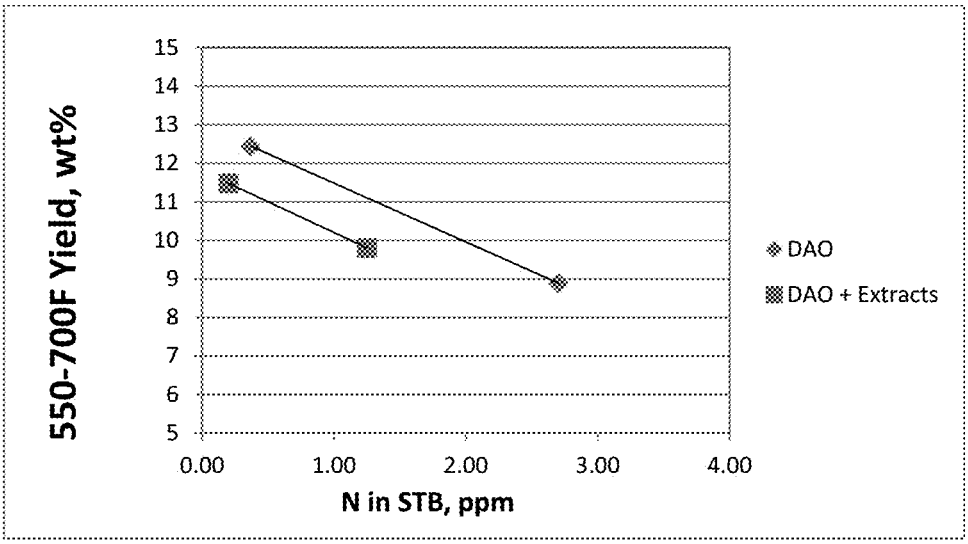
FIG. 14 is a chart of the yields of stripper bottom products that boil in the range of 550° F. (288° C.) to 700° F. (371° C.), made by the processes of this invention.
Figure 15:
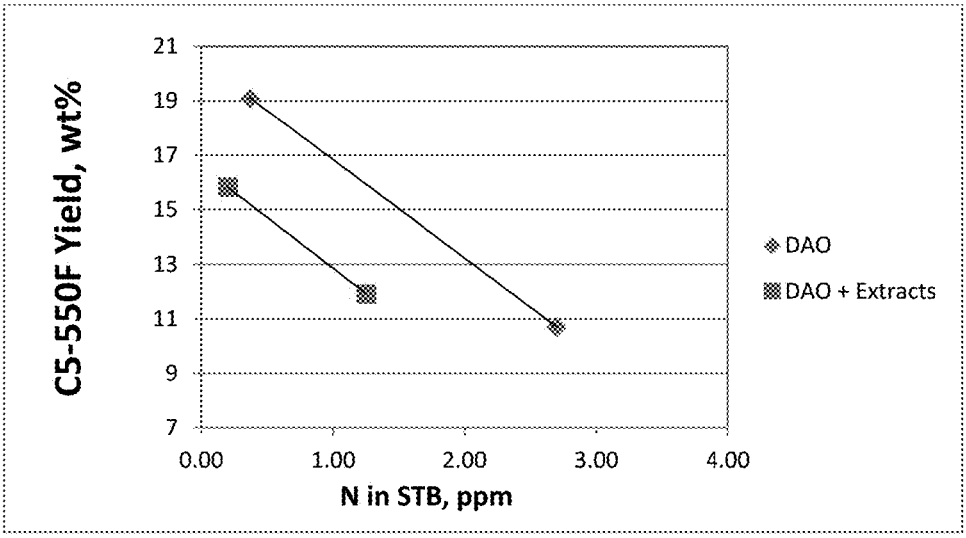
FIG. 15 is a chart of the yields of stripper bottom products that boil in the range of C5 to 550° F. (288° C.), made by the processes of this invention.

The blending of aromatic extract into deasphalted oil was shown to upgrade the low value aromatic extract into a blended waxy feed that produces highly desired heavy base oil products, and would greatly increase the overall yield of high value Group II and Group II+ base oil products from a refinery that added this capability. FIGS. 12 and 13 show the improvement in yields of products boiling in the ranges of 700-950° F. and 950° F.+ that were obtained by using the mixed feeds in the processes of this invention. Surprisingly, when hydroprocessing the mixed feed the yields of products boiling in the range of 700-950° F. were greater than 36 wt % even when the products had less than 3 wt ppm nitrogen, which could not be achieved when hydroprocessing the deasphalted oil alone. Additionally, the blending of aromatic extract into deasphalted oil was shown to lower the aniline point of the stripper bottoms by at least 2° F. compared to runs when the deasphalted oil was hydroprocessed alone. Low aniline point is desired in heavy base oil products, as the low aniline point improves the solubility of additives that are blended into the heavy group II base oil to make finished lubricants.

Example 4

Analysis of Aromatic Content in Feeds and Stripper Bottoms

Figure 9:
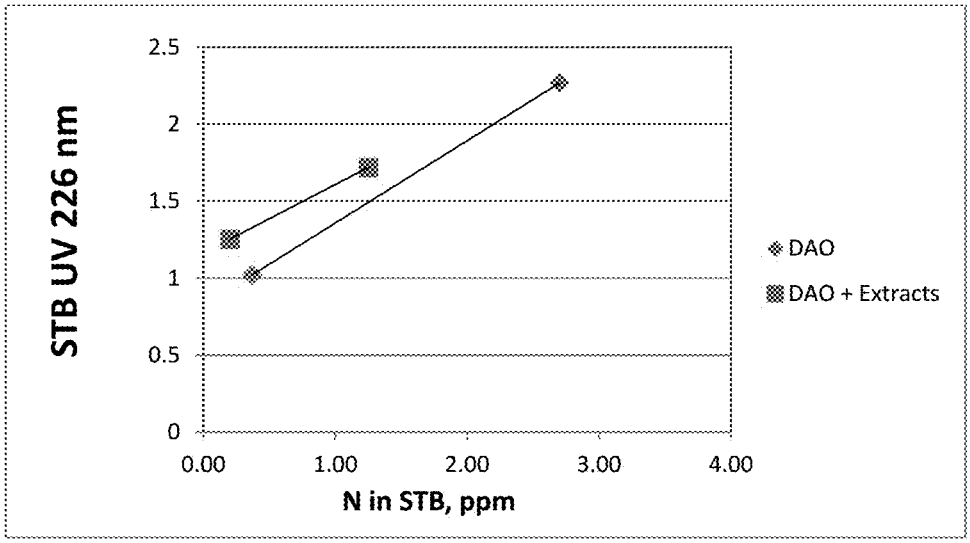
FIG. 9 is a chart of the UV absorbances at 226 nm of the stripper bottom products made by the processes of this invention.
Figure 10:
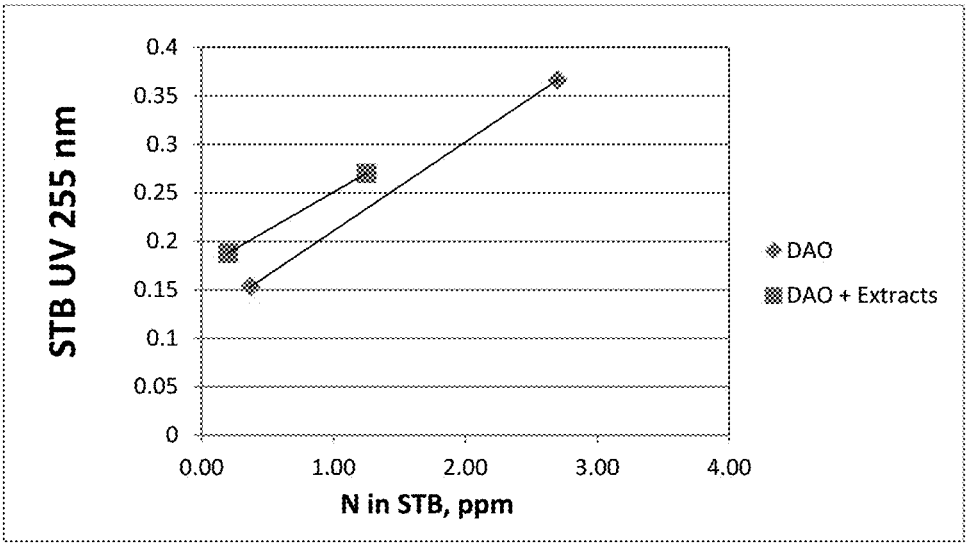
FIG. 10 is a chart of the UV absorbances at 255 nm of the stripper bottom products made by the processes of this invention.
Figure 11:
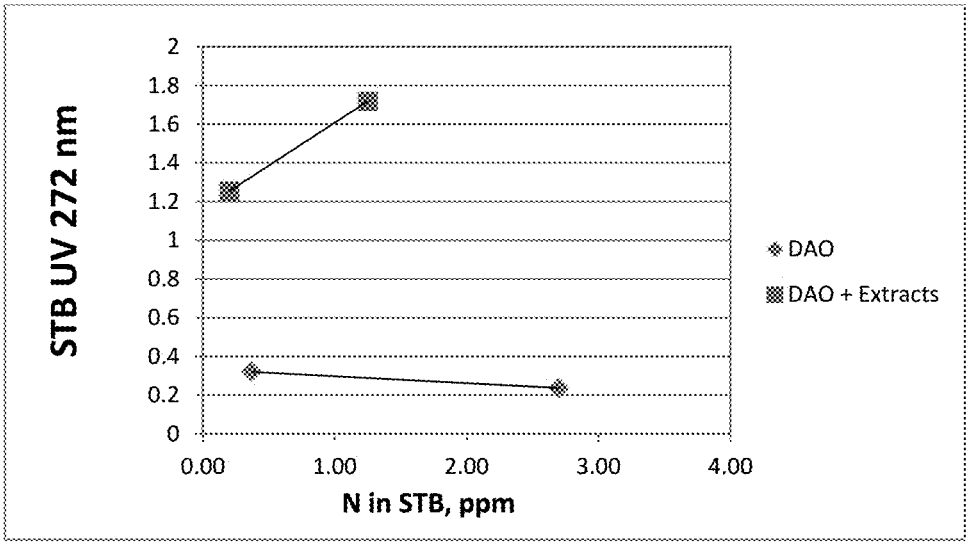
FIG. 11 is a chart of the UV absorbances at 272 nm of the stripper bottom products made by the processes of this invention.

The UV absorption of stripper bottom products from the runs described in Example 3 are shown in FIGS. 9-11. The UV absorption is an indication of aromatic content in the stripper bottoms. UV absorption results are shown in FIGS. 9-11 for the runs operated under process conditions to produce a low nitrogen level, and also for the runs operated under milder process conditions to produce a high nitrogen level. Notably, even though the Blend of Deasphalted Oil with Aromatic Extract had significantly higher aromatic content compared to the Deasphalted Oil feed (see Table 8) the stripper bottom products made by hydroprocessing of the mixed feed were only slightly higher in aromatic content compared to the stripper bottom products made by hydroprocessing of the deasphalted oil alone. This feature is also shown in the aromatic hydrocarbon analyses for the same runs in FIG. 6.

Example 5

Analysis of Hydrocarbon Types in Feeds and Stripper Bottoms

Figure 6:
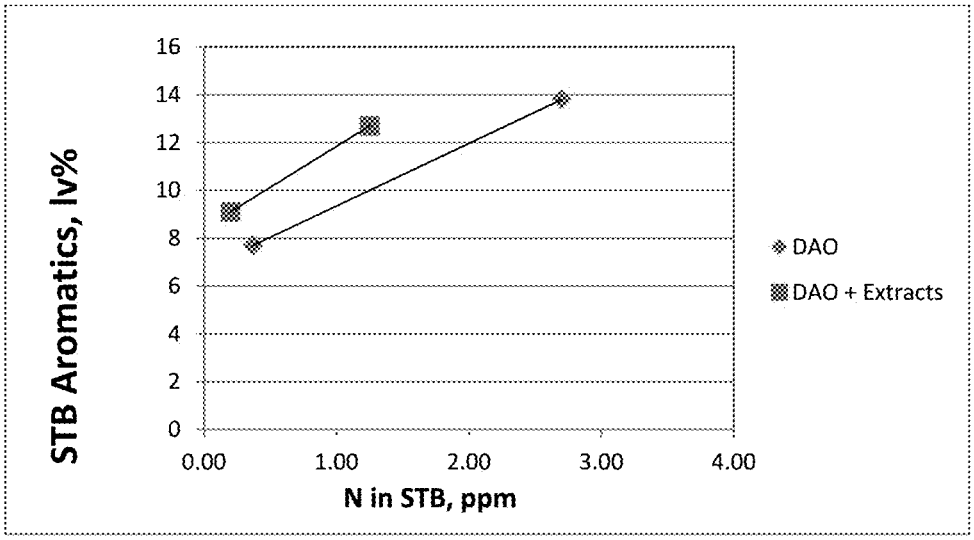
FIG. 6 is a chart of the aromatic hydrocarbon analyses, by 22×22 mass spectroscopy, of the stripper bottom products made by the processes of this invention.
Figure 7:
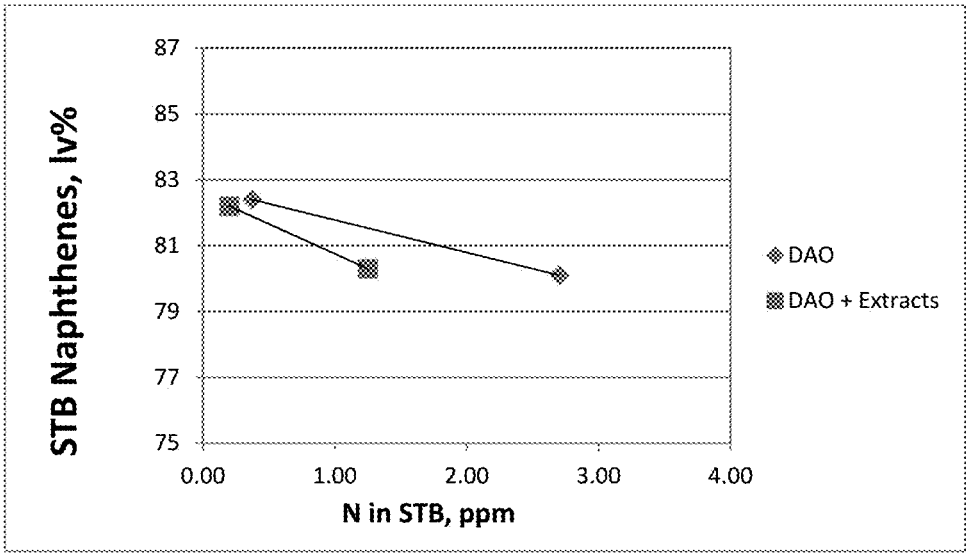
FIG. 7 is a chart of the naphthenic hydrocarbon analyses, by 22×22 mass spectroscopy, of the stripper bottom products made by the processes of this invention.
Figure 8:
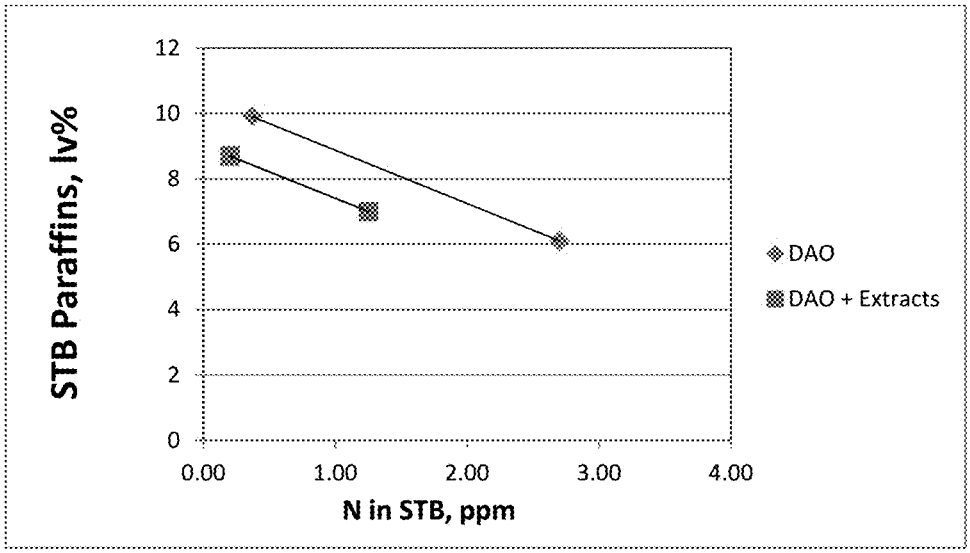
FIG. 8 is a chart of the paraffinic hydrocarbon analyses, by 22×22 mass spectroscopy, of the stripper bottom products made by the processes of this invention.

A hydrocarbon type analysis of the feeds and their stripper bottom products from the runs described in Example 3 are shown in FIGS. 6-8. The hydrocarbon type analysis was done by 22×22 mass spectroscopy, according to the method described in Gallegos, E. J.; Green, J. W.; Lindeman, L. P.; LeTourneau, R. L.; Teeter, R. M. Petroleum Group-Type Analysis by High Resolution Mass Spectrometry. Anal. Chem. 1967, 39, 1833-1838. Surprisingly, the hydrocarbon types in the stripper bottom products from the runs using the mixed feed were very similar to the hydrocarbon types in the stripper bottom products from the runs using the deasphalted oil alone. In all of the runs, the stripper bottom products had an amount of aromatic hydrocarbons from 2.9 to 13.8 liquid volume percent (lv %), an amount of naphthenic hydrocarbons from 73 to 86.7 lv %, and an amount of paraffinic hydrocarbons from 2.3 to 24.1 lv %. Additionally, the sulfur content in all of the stripper bottom products was 0 lv %. In the runs using the mixed feed the stripper bottom products had an amount of paraffinic hydrocarbons from 6.1 to 8.7 lv %.

The transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

For the purposes of this specification and appended claims, unless otherwise indicated, all numbers expressing quantities, percentages or proportions, and other numerical values used in the specification and claims, are to be understood as being modified in all instances by the term "about." Furthermore, all ranges disclosed herein are inclusive of the endpoints and are independently combinable. Whenever a numerical range with a lower limit and an upper limit are disclosed, any number falling within the range is also specifically disclosed. Unless otherwise specified, all percentages are in weight percent.

Any term, abbreviation or shorthand not defined is understood to have the ordinary meaning used by a person skilled in the art at the time the application is filed. The singular forms "a," "an," and "the," include plural references unless expressly and unequivocally limited to one instance.

All of the publications, patents and patent applications cited in this application are herein incorporated by reference in their entirety to the same extent as if the disclosure of each individual publication, patent application or patent was specifically and individually indicated to be incorporated by reference in its entirety.

This written description uses examples to disclose the invention, including the best mode, and also to enable any person skilled in the art to make and use the invention. Many modifications of the exemplary embodiments of the invention disclosed above will readily occur to those skilled in the art. Accordingly, the invention is to be construed as including all structure and methods that fall within the scope of the appended claims. Unless otherwise specified, the recitation of a genus of elements, materials or other components, from which an individual component or mixture of components can be selected, is intended to include all possible subgeneric combinations of the listed components and mixtures thereof.

The invention illustratively disclosed herein suitably may be practiced in the absence of any element which is not specifically disclosed herein.

It is claimed:

1. A process for heavy base oil production, comprising:

a. performing an aromatic extraction of a first hydrocarbon feed to produce an aromatic extract, and a waxy raffinate for further solvent dewaxing;

b. mixing the aromatic extract with a second hydrocarbon feed to make a mixed feed having greater than 2,000 wt ppm sulfur;

c. feeding the mixed feed to a hydroprocessing unit configured to produce a heavy API Group II base oil having a kinematic viscosity at 70° C. from 22.6 to 100 $mm^2/s$; and d. distilling the heavy API Group II base oil to produce a bright stock.

2. The process of claim 1, wherein the aromatic extract comprises from 30 to 80 vol % aromatics.

3. The process of claim 1, wherein the hydroprocessing unit performs hydrotreating, catalytic dewaxing, and hydrofinishing.

4. The process of claim 1, wherein the waxy raffinate is solvent dewaxed and hydrofinished to produce a heavy API Group I base oil.

5. The process of claim 1, wherein the mixed feed has an initial boiling point less than 340° C.

6. The process of claim 1, wherein the mixed feed comprises from 5 to 20 wt % of the aromatic extract.

7. The process of claim 1, wherein the heavy API Group II base oil has a VI of 100 to 120.

8. The process of claim 1, wherein the heavy API Group II base oil has less than 1.5 wt ppm nitrogen and an aniline point less than 260° F. (126.7° C.).

9. The process of claim 1, wherein the bright stock has an ISO-VG of ISO-VG 320 or ISO-VG 460.

10. The process of claim 1, wherein an operating temperature in the hydroprocessing unit is less than 750° F. (399° C.).

11. The process of claim 1, additionally comprising separating a stripper bottoms from an effluent of a combined hydrotreating and hydrocracking unit located within the hydroprocessing unit, wherein the combined hydrotreating and hydrocracking unit is operated under hydroprocessing conditions and using one or more hydrocracking catalysts to produce the stripper bottoms comprising 1 to 15 lv % aromatic hydrocarbons, 70 to 90 lv % naphthenic carbons, and 1 to 25 lv % paraffinic hydrocarbons, and having the kinematic viscosity at 70° C. greater than 22.6 $mm^2/s$.

* * * * *